United States Patent [19]

Sheer et al.

[11] Patent Number: 4,472,172

[45] Date of Patent: Sep. 18, 1984

[54] ARC GASIFICATION OF COAL

[76] Inventors: Charles Sheer, 196 Herrick Ave., Teaneck, N.J. 07666; Samuel Korman, 251 Adams La., Hewlett, N.Y. 11557; Thomas J. Dougherty, 160 W. 96th St., New York, N.Y. 10025

[21] Appl. No.: 99,833

[22] Filed: Dec. 3, 1979

[51] Int. Cl.[3] ..... C10J 3/46

[52] U.S. Cl. ..... 48/202; 44/1 F; 48/65; 48/210; 204/170; 204/173; 252/373

[58] Field of Search ..... 48/197 R, 202, 6 J, 48/210; 252/373; 219/121 P; 44/1 F; 423/459; 204/170, 173

[56] References Cited

U.S. PATENT DOCUMENTS

| | | | |
|---|---|---|---|
| 1,447,259 | 3/1923 | McDonald | 204/170 |
| 3,288,696 | 11/1966 | Orboch | 204/173 |
| 3,384,467 | 5/1968 | Ammann et al. | 48/210 |
| 4,080,550 | 3/1978 | Sheer et al. | 219/121 PQ |

OTHER PUBLICATIONS

The Sheer-Korman Arc Process, Sheer et al., 12-1975, Sheer-Korman Associates, Inc.

Sheer et al., "Arc Synthesis of Hydrocarbons", pp. 42-53 of Coal Gasification, Am. Chem. Soc. Advances in Chemistry Series, No. 131, 1974.

Groves et al., "Reactions of Coal in a Plasma Jet", I.S.E.C., Vol. 5, No. 1, Jan. 1966, pp. 59-62.

*Primary Examiner*—Peter F. Kratz

[57] ABSTRACT

A process for the gasification of coal consisting essentially of forming a free-burning arc discharge between at least one anode and a cathode having a conical tip, wherein said arc discharge forms a contraction of the current-carrying area in the transition region in the vicinity of the cathode, forcefully projecting a reactive material consisting of a mixture of pulverized coal and steam parallel to the surface of said conical tip of said cathode and through said contraction of the current-carrying area in the transition region in the vicinity of the cathode, at such a rate that said mixture of pulverized coal and steam is exposed to the free-burning arc for less than 3 milli-seconds, and recovering a solid carbonaceous fume having a surface area equivalent to a particle size in the range of 0.01 to 0.2 microns and a gaseous product comprising of hydrogen, carbon monoxide and carbon dioxide. The carbonaceous fume is highly reactive and in a second steam treatment step is readily converted to gas at a rate of an order of magnitude higher than that for a conventionally devolatilized coal char.

10 Claims, 8 Drawing Figures

SCHEMATIC OF COAL GASIFICATION BY S.K.A. PROCESS SHOWING THREE PRODUCT OPTIONS

GASIFICATION RATE vs TEMPERATURE

A—COAL FUME AT 80 PSIG

B—DEVOLATILIZED COAL AT 300 PSIG

GAS COMPOSITION vs TEMPERATURE
COAL FUME (80PSIG); DEVOLATILIZED COAL (300PSIG)

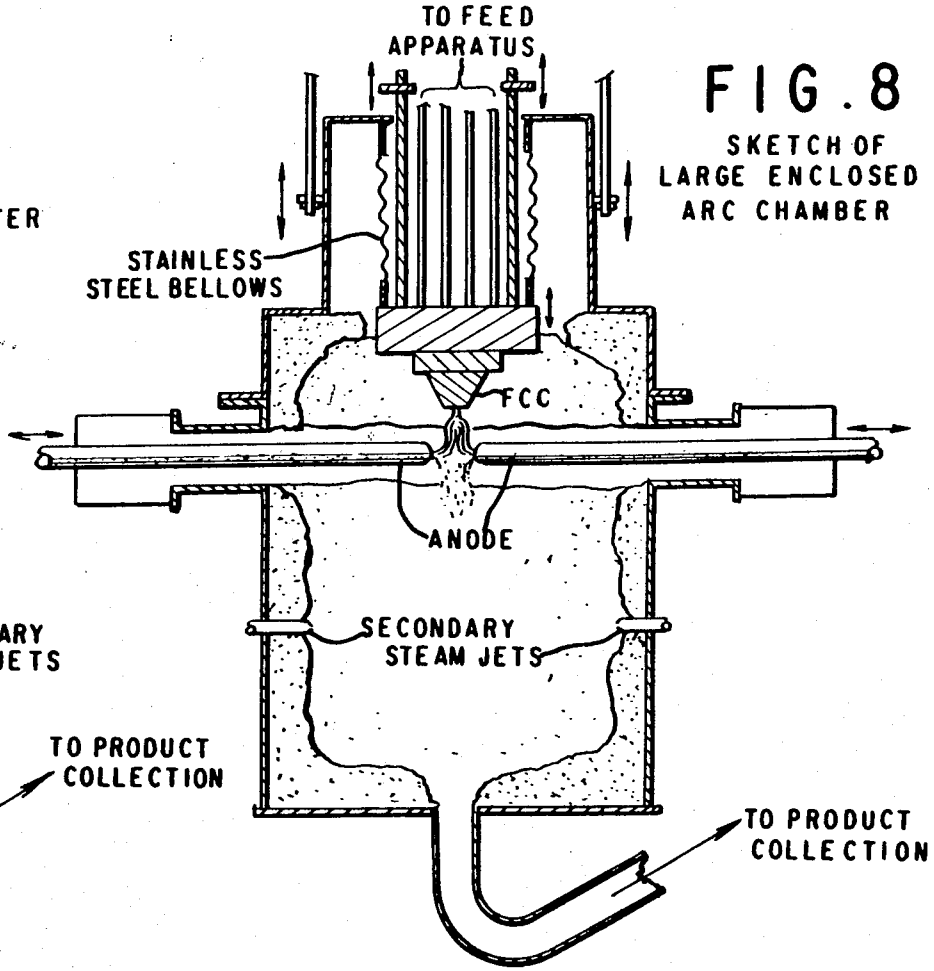
FIG. 8 SKETCH OF LARGE ENCLOSED ARC CHAMBER
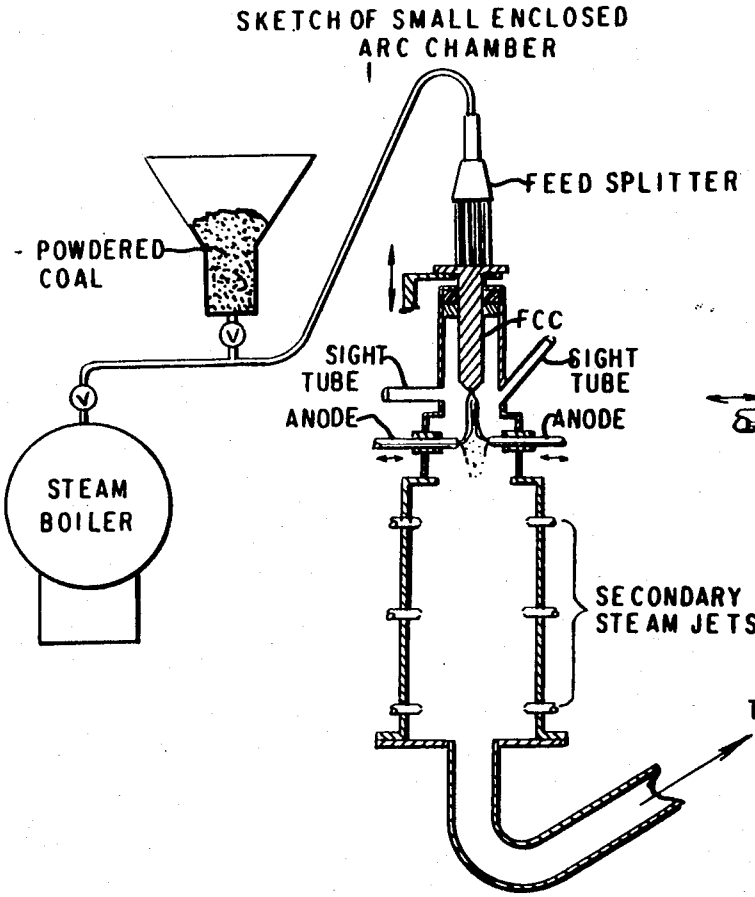
FIG. 7 SKETCH OF SMALL ENCLOSED ARC CHAMBER

ARC GASIFICATION OF COAL

BACKGROUND OF THE INVENTION

The gasification of coal by means of an economic and efficient technology has been a focus of attention for many years. Spurred by the increasing energy shortage, it has provided the motive for the introduction of a variety of second generation gasification schemes which are presently in varying stages of development. These are based on one of three gasification approaches, namely, fixed bed, fluidized bed, or entrained gasifiers. These processes are handicapped by all, or nearly all, of the following requirements:

1. Need for an oxygen plant.
2. Product desulfurization required.
3. Excessive amounts of cooling water required.
4. Incomplete carbon utilization.
5. Limited to non-caking coals, or
6. Pre-treatment of caking coals required.
7. Tars produced and must be eliminated.
8. Expensive refractories required.
9. Large amounts of heating fuel required.
10. High pressure for reaction vessles may be required.
11. Low gasification rates.
12. Expensive methanation catalysts used.

Improvements over the traditional gasification processes, such as the Lurgi or Koppers-Totzek processes, appear to be marginal at best. The net result is that the cost of product gas by any of these second generation processes is prohibitive and, more particularly, the capital investment projected for commercial-size plants has been so large as to inhibit their construction.

It has been proposed in U.S. Pat. No. 4,080,550 to inject powdered coal in a carrier gas into a free-burning arc column. Likewise, it was proposed in U.S. Pat. No. 3,644,781 to inject powdered coal in hydrogen into a free-flowing arc column.

Methods and devices for transferring energy to fluid materials also by exposing said fluid material to the energy of a high intensity arc have been previously reported. For example, in U.S. Pat. No. 3,209,193, a novel method of exposing the fluid to the energy of the arc is disclosed, which consists of passing the fluid continuously through a porous anode so that it enters the discharge via the active anode surface, i.e., where said surface is acting as the arc terminus. That patent further discloses that unique and valuable results can be obtained if certain criteria are satisfied in operating such a device.

U.S. Pat. No. 3,214,623 describes an improvement to the above patent where the arc discharge has an essentially conical geometry. The cathode, porous anode and insulating supports are arranged geometrically to each other, so that the conduction column assumes the shape of an axially symmetrical conical shell.

The technique of fluid injection through a porous anode has been termed the "fluid transpiration arc" (FTA), and is an example of the use of a high intensity arc to transfer energy to materials.

Attempts have also been made to inject a working fluid into the interior of an arc column at other points than the anode. Many difficulties have been found in these attempts. For example, in the constricted arc column of a conventional wall-stabilized arc with a segmented, watercooled constrictor channel long enough to assure the establishment of a fully developed column, the injected gas is forced to flow axially, concentric and parallel to the conduction column. Since the column in this device is subject to an appreciable thermal constriction, it would seem that the convected gas would be forced through the column boundary into the primary energy dissipating zone. It was found, however, that, even in the fully developed region, beyond which the radial distributions of the flow parameters remain essentially constant, by far the major part of the flow traverses the thin, cool, nonconducting gas film adjacent to the channel wall. In fact only about 10 percent of the mass flow enters the hot core of the constructed arc column. The much higher density and lower viscosity of the cool gas in the wall layer, plus the fact that even a very thin film can have appreciable cross-sectional area near the wall, compensate for the lower velocity of the cool gas layer, and account for nearly all of the convected mass flow. It should be noted that the radial temperature across the fully developed portion of the column remains above 10,000° K., over 80 percent of the channel diameter, so that the plasma fills the channel quite well. The conclusion is that most of the working fluid does not penetrate the column and is therefore not directly exposed to the zone of maximum energy dissipation.

The same effect is noted with other flow configurations. For example, if a stream of gas is projected at right angles against the column of a free-burning arc, the arc will be blown out at quite low flow rates. However, the column can be stabilized by a magnetic field of suitable strength oriented normal to both column and gas flow so as to balance exactly the force of convection. Even when the balance is established at very high-flow rates, the gas does not enter the column, but is deflected around it, the column behaving much like a hot solid cylinder. An examination of existing arc jet devices reveals that in nearly every case most of the working fluid does not penetrate into the column and is not subjected to the zone of direct energy transfer.

A most important development in the process of injecting a working fluid into the interior of an arc column was described in U.S. Pat. Nos. 3,644,781 and 3,644,782. These patents describe how the contraction zone, wherein the current-carrying area of the arc column decreases and which is formed adjacent to the cathode tip, can serve as an "injection window" into the arc column. Thus, when a gas is caused to impinge directly on the contraction zone boundary it will penetrate into the arc column at flow rates far in excess of what can be forced across the cylindrical column boundary of the arc. Gas flow rates of the magnitude much greater than that aspirated naturally can be injected into the column without disturbing the stability of the arc provided the gas is forced to follow the conical configuration of the cathode tip and impinges on the column at the contraction zone. For this purpose, the gas to be injected must be formed in a high-velocity layer and projected along the conical cathode surface.

By proper adjustment of the gas velocity and cone angle of the cathode, the gas can be made to cross the column boundary in essentially the same general direction as would the aspirated ambient gas stream in the absence of forced cnvection. The optimum cone angle for this purpose appears to be between 30° and 60°.

A second critical parameter described in these patents is the injection velocity. This can be be varied without altering the total mass flow (convection rate) by varying the area of the annular orifice and changing the inlet gas pressure as required to maintain a fixed flow rate. It was observed, for example, that as the injection velocity (mass flow density) was varied, the column temperature passes through a peak, with the maximum temperature rising to two or three times that obtained when the velocity was several times higher or lower than its optimum value.

A third critical parameter described in these patents is the total mass flow of the injected fluid medium. As the total mass flow of the injected fluid medium is varied at substantially constant current levels and mass flow density, an alteration of the shape of the contraction zone occurs. When the total mass flow or convection rate of the injected fluid medium is increased from zero, little or no change in the shape of the contraction zone is observed and substantially all of the injected fluid enters the arc column through the injection window. However, as the total mass flow of the injected fluid medium is increased further, at a point depending on the medium injected, the contraction zone begins to elongate, thus decreasing the space rate of contraction of the arc column diameter. This space rate of contraction may be characterized by the window angle $\alpha$ (see FIG. 1). When the angle $\alpha$ is sufficiently reduced, that is, about 40° or less, the major portion of the flow of the fluid medium does not enter the arc column.

This technique of injecting the working fluid into the contraction region of the arc column has been termed the "forced convection cathode" are (FCC), and is principally described in U.S. Pat. No. 3,644,782. U.S. Pat. No. 3,644,781 describes the operation of the FCC with a heterogeneous material where the introduction into the fluid medium injected of a finely divided non-gaseous material causes an enlargement of the window angle $\alpha$, thus enabling the insertion of an increased amount of the non-gaseous material.

An improvement in the operation of the FCC is described in U.S. Pat. No. 3,900,762 which involves interposing a stream of shielding gas between the cathode producing the arc and the reactive material being inserted into the arc.

A further improvement in the operation of the FCC with insertion of large amounts of reactive material such as powdered coal is described in U.S. Pat. No. 4,080,550 which describes an improvement in the process of energizing a reactive material comprising a solids-containing fluid medium by means of a free-burning arc discharge between an anode and a cathode having a conical tip, wherein said arc discharge forms a contraction of the current-carrying area in the transition region adjacent to the cathode and wherein said reactive material is forcefully projected along the surface of said conical tip of said cathode into and through said contraction of the current-carrying area in the transition region adjacent to the cathode, the said improvement comprising projecting said reactive material through a plurality of individual linear feed channels having a constant flow cross-sectional area, said individual feed channels being supplied from a common source of a solids-containing fluid medium through flow splitters having two or more converging channels on the outlet side of equal cross-sectional area forming an angle of 15° or less opening into a channel of the same or greater cross-sectional area as the combined area of the two or more converging channels whereby the flow of said solids-containing fluid medium is divided into streams of equal flow rate and grain loading; and extensively cooling the outlet area of said plurality of individual linear feed channels whereby the surace temperature of said outlet area is maintained below the temperature at which the solids in said solids-containing fluid medium agglomerate.

When the concept is applied to the treatment of powdered coal and steam in the plasma arc, the cost of electrical energy is about three times that of the equivalent amount of the thermal energy generated by the combustion of fossil fuels. This is especially true when the electrical heating source involves an arc plasma device which generates temperatures an order of magnitude greater than required for coal gasification and which, therefore, is subject to greater losses than, for instance, an electrical resistance furnace.

The first step in most gasifiers is the well-known water-gas reaction:

$$C+H_2O \rightarrow H_2+CO \quad (1)$$

This reaction is quite endothermic. Thus, assuming the product gases issue at 1000° K., a calculation of the heat input to supply reaction (1) plus sensible heat, totals 1232 K-Cal per lb. of coal fed, based on Sewickley coal obtained from southwestern Pennsylvania. In electrical units this amounts to 1.43 KWH/lb. of coal. To supply all of this energy electrically would be very expensive, especially in consideration of the low efficiency of electrical power generation.

Accordingly, the process of the present invention is so operated as to reduce the consumption of electrical energy to a minimum, i.e., to a small fraction of the 1.43 KWH per lb. of coal cited above, preferably considerably less than 0.5 KWH/lb. of coal. The manner in which this is accomplished by a two-stage treatment of the coal will be explained in detail in the following.

OBJECTS OF THE INVENTION

An object of the present invention is the production of gas from powdered coal and steam employing the energy from an arc plasma device in a manner which is economical and avoids the drawbacks of the prior art discussed above.

Another object of the present invention is the development of a process for the gasification of coal consisting essentially of forming a free-burning arc discharge between at least one anode and a cathode having a conical tip, wherein said arc discharge forms a contraction of the current-carrying area in the transition region in the vicinity of the cathode, forcefully projecting a reactive material consisting of a mixture of pulverized coal and steam parallel to the surface of said conical tip of said cathode and through said contraction of the current-carrying area in the transition region in the vicinity of the cathode, at such a rate that said mixture of pulverized coal and stem is exposed to the free-burning arc for less than 3 milli-seconds, and recovering the major portion of the coal fed in the form of a solid carbonaceous fume having an equivalent spherical particle size in the range of 0.01 to 0.2 microns, along with a gaseous product comprising of hydrogen, carbon monoxide and carbon dioxide, produced by the reaction of steam with a minor fraction of the coal fed to the plasma device.

A further object of the present invention is the development of a two-stage process for the gasification of coal consisting essentially of forming a free-burning arc discharge between at least one anode and a cathode having a conical tip, wherein said arc discharge forms a contraction of the current-carrying area in the transition region in the vicinity of the cathode, forcefully projecting a reactive material consisting of a mixture of pulverized coal and steam parallel to the surface of said conical tip of said cathode and through said contraction of the current-carrying area in the transition region in the vicinity of the cathode, at such a rate that said mixture of pulverized coal and steam is exposed to the free-burning arc for less than 3 milli-seconds, recovering the major portion of the coal fed in the form of a solid carbonaceous fume having a particle size in the range of 0.01 to 0.2 microns and a gaseous product comprised of hydrogen, carbon monoxide and carbon dioxide, reacting said solid carbonaceous fume with steam at elevated temperatures and pressures and recovering more of said gaseous product.

These and other objects of the present invention will become more apparent as the description thereof proceeds.

THE DRAWINGS

FIG. 7 is a sketch of the small enclosed arc referred to in Example (2).

FIG. 8 is a sketch of the large enclosed arc referred to in Example (3).

DESCRIPTION OF THE INVENTION

The above objects have been achieved and the drawbacks of the prior art have been overcome by the present invention. This invention relates to a process in which powdered coal entrained in steam is pre-treated in an arc plasma and, thereby, largely converted into a finely divided, highly reactive carbonaceous fume. Only a minor percentage of the coal fed is gasified in the arc. The carbonaceous fume is then treated with steam in a separate post-arc reactor to carry out the gasification reaction for the major portion of the coal under much milder conditions using only combustion energy input.

More particularly, therefore, the present invention relates to a two-stage process for the gasification of coal consisting essentially of forming a free-burning arc discharge between at least one anode and a cathode having a conical tip, wherein said arc discharge forms a contraction of the current-carrying area in the transition region in the vicinity of the cathode, forcefully projecting a reactive material consisting of a mixture of pulverized coal and steam parallel to the surface of said conical tip of said cathode and through said contraction of the current-carrying area in the transition region in the vicinity of the cathode, at such a rate that said mixture of pulverized coal and steam is exposed to the free-burning arc column for less than 3 milli-seconds, recovering the major portion of the coal fed in the form of a solid carbonaceous fume having an equivalent particle size in the range of 0.01 to 0.2 microns and a surface area in the range of 40 to 100 $m^2/gm$, along with a gaseous product comprised of hydrogen, carbon monoxide and carbon dioxide, reacting said solid carbonaceous fume with steam at elevated temperatures and pressures and recovering more of said gaseous product.

Figure 2:
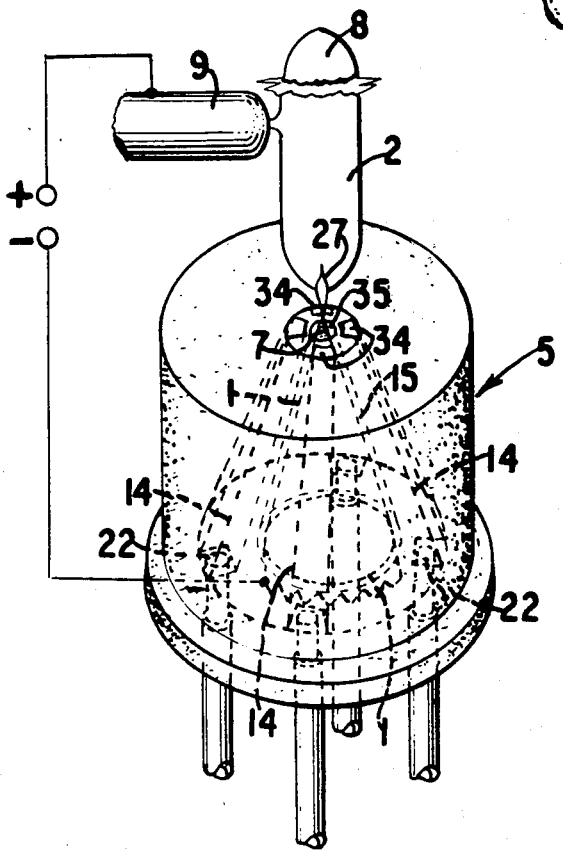
FIG. 2 is a perspective view of the prior art device employed in the process of the invention.

The proposed gasification process is, therefore, essentially a two-stage process in which most of the coal is preconditioned by rapid passage through an arc plasma device prior to being gasified. The coal in powdered form is entrained in steam and injected into a special nozzle fitted around the cathode of a DC electric arc so as to penetrate into and flow through the high temperature zone within and immediately surrounding the arc column (as is described in U.S. Pat. No. 4,080,550). The coal, is, therefore, exposed to a very high temperature (up to 10,000° K.) for an extremely brief period. Residence times in the arc zone are less than 3 milliseconds, for example, typically about 1 millisecond. The arc plasma device used in this process is that described in U.S. Pat. No. 4,080,550 and is known as the "FCC". FIG. 2 shows a sketch of the FCC device. The effluent of the arc consists of two products:

(1) a gaseous product due principally to devolatilization and also to the gasification of a minor amount of carbon enroute;

(2) a solid product consisting of high surface area carbonaceous fume, whose equivalent particle size typically in the 0.01 to 0.2 micron range and whose surface area is in the range of 40 to 100 $m^2/gm$. The solid product is also characterized by a high degree of chemical reactivity. Depending on the feed rate and the coal to steam ratio, the amount of carbonaceous fume may be as high as 75% or more of the amount of carbon in the coal fed.

Figure 5:
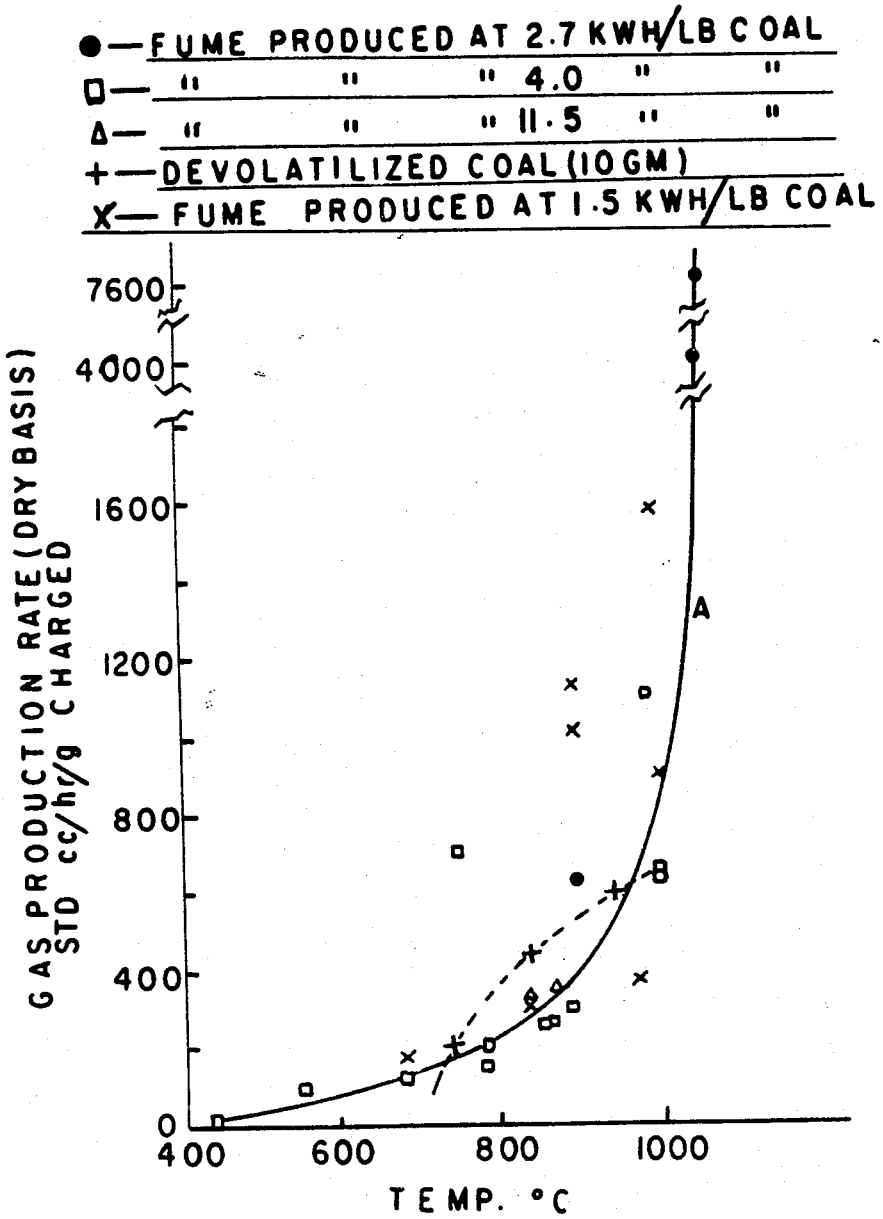
FIG. 5 is a graph of the coal gasification rate versus temperature.

The gaseous product was found to consist principally of $H_2$, CO, and $CO_2$, with the following average percentages: $H_2$—60%, CO—30%, $CO_2$—10%. The post-arc steam treatment of the fume product was carried out either in a flow-type reactor or by using a fixed bed, and yielded essentially the same products, with about the same percentages. A fluidized bed may also be used for this purpose, as is well-known in the art. The gasification rate employing the carbonaceous fume of the invention at 900° C. and 80 psig was approximately twice as great as that for ordinary char at 900° C. and 300 psig which had been made from conventionally devolatilized coal as described by Haynes et al, "Catalysis of Coal Gasification at Elevated Pressures", Advances in Chemistry Series, #131, Coal Gasification, American Chemical Society, Washington D.C., 1974, pp. 179–202. FIG. 5 is a graph of the coal gasification rate versus temperature for the carbonaceous fume of the invention and the conventionally produced devolatilized coal.

The high reactivity of the coal fume is exemplified by the greater gasification rate at 900° C. for the fume as compared to the conventional char despite the fact that the char was treated at an absolute steam pressure (315 psia) more than three times as great as the pressure at which the fume was treated (95 psia). At a given temperature, the gasification rate increases linearly with absolute pressure. (See C. G. von Fredersdorff and M. A. Elliott, "Chemistry of Coal Utilization" (Suppl.

Vol.) ed. by H. H. Lowry, John Wiley, New York, 1963, Chapter 20, "Coal Gasification", page 987.). The anomalous results shown in FIG. 5 can only be interpreted as due to the superior chemical reactivity of the arc produced fume as compared to conventional char.

Figure 6:
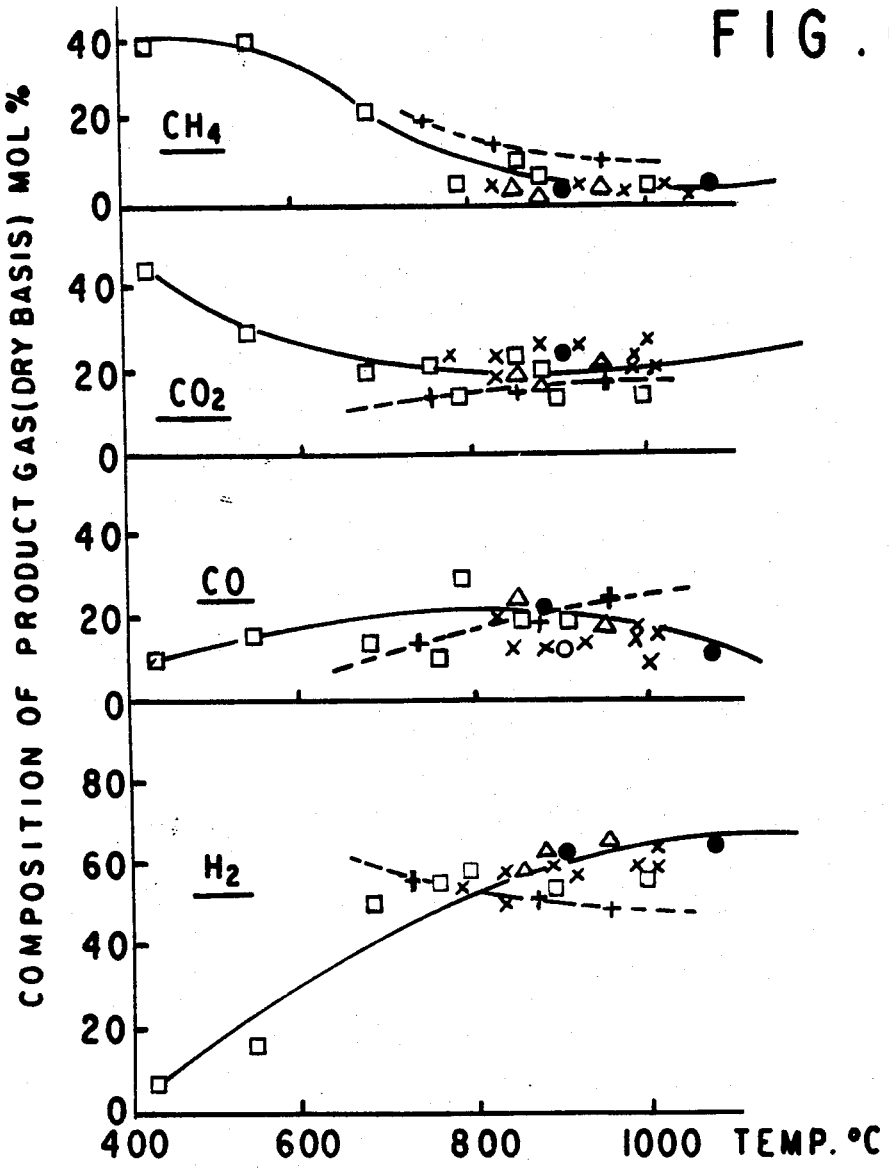
FIG. 6 is a graph of the gas composition versus temperature employing the carbonaceous fume of the invention.

When the gasification of the carbonaceous fume of the present invention in the presence of steam was conducted at lower temperatures, for example, 400° C. to 600° C. at the same pressures, although the conversion rate was slower, a high concentration of methane, plus other minor hydrocarbons appeared in the product, reaching as high as 40% of the output (as is shown in FIG. 6). It is also significant that the sulfur content of the product gases, either from the arc treatment or from the post-arc steam treatment, was either not detectable or else present in very low parts per million. The conversion of the coal from a relatively coarse powder (average diameter ~ 50 microns) into an ultrafine (<0.2 micron) highly reactive fume is due to the very rapid heating of the coal particles and the rapid rate at which volatile matter is released. The basis for the high chemical reactivity of the carbonaceous fragments (fume) is less clear; it is very likely associated with the large increase in surface area, but some other factor is probably also operative. The surface area is in the range of from 40 to 100 $m^2$/gm. for argon, nitrogen and steam carrier gas, but the high reactivity is achieved when the coal is entrained in steam, but not in argon or nitrogen. Hence, surface conditioning by steam is a possible factor. Also, when the FCC nozzle is not well designed, or inaccurately positioned with respect to the cathode tip, resulting in poor penetration of the feed into the arc zone, a noticeable decrease in reactivity for the product fume is observed.

The basis for the apparent autogenous desulfurization of the gaseous arc effluent may be ascribed to the effect of the arc treatment of the mineral matter in the coal. This is generally contained in coal in the form of stable complex sillicates, such as shale or clay. In passing through the arc zone, these compounds are believed to be decomposed into a mixture of finely divided simple oxides such as $Fe_2O_3$, $Al_2O_3$, $SiO_2$, etc. Several of these oxides are quite reactive at moderate temperatures and, ultimately, combine with sulfur gases to form stable compounds such as sulfides, sulfites, or sulfates, depending on the type of atmosphere, thereby, fixing the sulfur in solid form, removable by filtration or electrostatic precipitation along with the ash.

The direct production of significant percentages of methane in the output of the post-arc steam-fume reactor demonstrates that some decomposition products of the ash can, under appropriate conditions, serve as a methanation catalyst.

OPERATION OF THE FCC DEVICE

Figure 1:
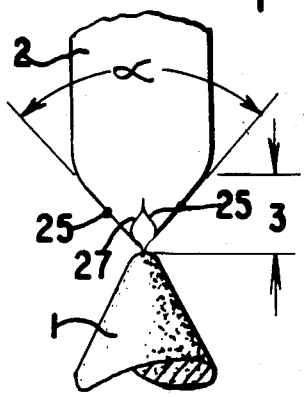
FIG. 1 is a schematic diagram of the prior art showing the plasma bubble and illustrating the arc column contraction, the degree of contraction being specified by the angle $\alpha$ in the vicinity of a cathode having a conical tip.

Referring to FIG. 1, when an arc is struck between an anode (not shown) and a cathode having a conical tip, there occurs a contraction of the current carrying area in the transition region between the cathode 1 and the conduction column proper 2. This contraction is indicated as contraction zone 3. The degree of contraction of the current carrying area in the transition region between the cathode 1 and the column proper 2 may be specified by the angle $\alpha$ which is determined by extending lines tangent to the column boundary at the points of inflection 25 of the contraction. This contraction gives rise to a non-homogeneous self-magnetic field associated with the arc current and creates a body force on the electrically conducting plasma within the contraction zone, impelling the plasma axially away from the cathode tip, thus causing the natural cathode jet effect. The movement of plasma away from the tip creates an inwardly directed pressure gradient in the vicinity of the cathode tip, so that contraction zone 3 serves as an "injection window" through which materials may be injected directly into arc column 2. In the absence of forced convection, gas from the ambient atmosphere is aspirated into the column through the contraction zone. The FCC nozzle replaces naturally aspirated atmospheric gas with the forced convection of a desired gaseous medium. Feed flow rates of a magnitude much greater than that aspirated naturally can be injected into the column through the injection window without disturbing the stability of the arc. The effect of the forced convection is to increase both the current density and the voltage gradient in and near the contraction zone, thereby increasing the volume rate of energy dissipation within this portion of the column, making available the additional energy needed to heat the increased quantity of material which penetrates into the column.

A distinctive feature of the contraction zone is a small brilliant tear drop shaped zone having a bluish tinge and located at the end of a conical cathode tip. This zone is hereinafter referred to as the "plasma bubble". It is shown, in FIG. 1, as reference 27. The temperature within the bubble is exceedingly high, generally in excess of 20,000° C., and it serves as a very effective generator of charge carriers (ions and electrons). During forced convection the charge carriers are being rapidly depleted and efficient generation of new charge carriers is necessary to prevent arc instability.

When the FCC is operating in steady state by projecting a gaseous medium into the arc column via the contraction zone "window", with the nozzle orifice area always adjusted for optimum mass flow density (maximum column temperature), the degree of penetration of the gaseous medium is determined by the window angle, $\alpha$. (See FIG. (1)). As mentioned earlier, the window angle 60 depends on the convection rate of gas, changing very little at low flow rates, but decreasing at high flow rates. When $\alpha$ drops to the region of 40°, the penetration becomes limited to a minor fraction of the total flow. If, however, under such conditions, i.e. if the total flow is high enough to cause a significant decrease in $\alpha$ and if all other conditions (arc current, mass flow density, and gas convection rate) are held constant, then the entrainment in the gas stream of a finely-divided non-gaseous material, e.g. a powdered coal, (which, however, generates gas or vapor within the column) will cause the angle $\alpha$ to increase, thus neutralizing the effect of the high gas convection rate on the window angle and improving the penetration beyond that for the gas alone.

The device employed to produce the carbonaceous fume of the present invention is depicted in FIG. 2.

The cathode 1 is water cooled and extends in the form of a conical tip with a 45° cone angle. Surrounding the cathode is a conical shroud 5 defining an annular passage 15. Shroud 5 also has a cone angle of 45° so that it mates with the conical tip of the cathode. Shroud 5 is pierced with a plurality of linear feed channels 14 which form paths substantially parallel to annular passage 15. These linear feed channels 14 are of a uniform cross-sectional area throughout the entire length of shroud 5. Both annular passage 15 and linear feed channels 14 are shown to be parallel to the surface of the conical cathode. However, the linear feed channels 14 can vary slightly from being substantially parallel to the surface of the conical cathode 1. The linear feed channels 14 are preferably fed equal amounts of powdered coal and steam. This is accomplished by the use of a feed splitter as described in U.S. Pat. No. 4,080,550.

Shroud 5 terminates a few millimeters behind the cathode tip 7, thus forming annular orifice 35. The linear feed channels 14 through shroud 5 have orifices at 34. Preferably they are equally spaced apart from each other about the cathode tip 7.

Annular passage 15 is effective in interposing a stream of shielding gas between the coal-containing fluid medium in linear feed channels 14 and the cathode 1.

This stream of shielding gas is useful in order to maintain the integrity of the conical tip. By this method, the conical cathode tip is protected or shielded against physical abrasion and/or chemical attack by reactive materials which are projected along the linear feed channels 14 or which back diffuse from the column.

By shielding gas is meant any gas which is not active, i.e., chemically reactive toward the cathode material, at prevailing cathode temperatures during arc operation.

Typical shielding gases, especially with tungsten or copper electrodes, are the following: helium, argon, neon, nitrogen, hydrogen and the like.

In addition to protecting the conical cathode surface against physical abrasion and chemical attack, interposing a stream of shielding gas between the cathode and the reactive material fed into the injection window in accordance with the present invention surprisingly widens the conduction column beyond the contraction zone and contributes vastly to arc stability. The basis for this surprising phenomena is believed to be associated with the "plasma bubble".

In any event, the size and shape of the plasma bubble appears to be influenced by the material projected into the column via the injection window. Injection of a non-reactive gas into the column through the portion of the injection window close to the cathode tip 7 enlarges the plasma bubble and increases its temperature. However, introducing reactive material such as polyatomic gases or solids into the plasma bubble, reduces the bubble temperature and therefore also the ion generation rate. This decrease of charge carriers in the conduction column, occurring as a result of forced convection, renders the arc unstable and ultimately extinguishes it. In contrast, when a non-reactive shielding gas is interposed between the cathode and the reactive material fed into the arc column via the injection window, the non-reactive gas enters the plasma bubble without depleting charge carrier generation, while the reactive material is injected essentially above the plasma bubble so that little or no reactive material enters it and is fed to the column without detrimentally affecting arc stability.

Accordingly, the linear feed channels 14 are designed in order that the reactive material (e.g., coal in steam) enters the column through the injection window along a path which intersects just beyond the bubble. The concomitant result is a widening of the column just above the plasma bubble, thus creating additional window space.

The dimensions of the annular orifice 35 and the feed channel orifices 34 are such that both streams of fluids can enter the column via the contraction zone or window. The inlet orifice area together with the inlet gas pressures will affect the injection velocity (mass flow density). By adjusting the gas pressure, the injection velocity may be varied without altering the total mass flow (convection). Preferably the shielding gas and reactive fluid orifices are sized so that little, if any, reactive material enters the plasma bubble and instead the reactive material enters the injection window along a path which intersects just beyond the plasma bubble.

Figure 4:
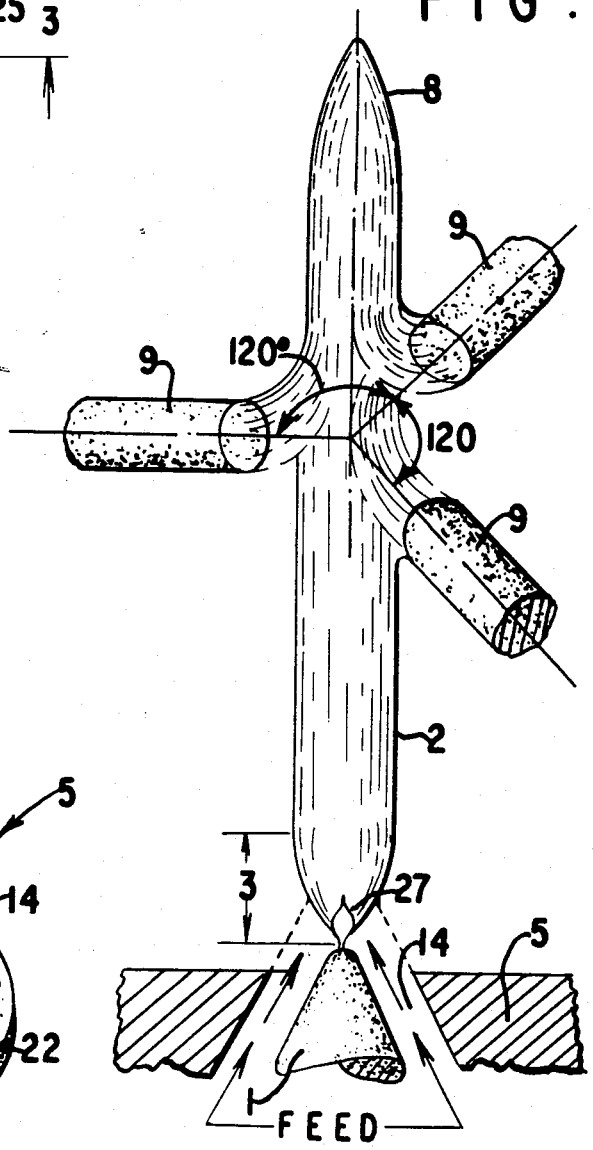
FIG. 4 is a simplified diagram of the arc plasma generation consisting of the FCC with a triple anode configuration of the prior art.

FIGS. 2 and 4 show an overall configuration of the FCC device showing the anodes 9 and the tail flame 8 of arc column 2. Preferably 3 or more anodes are employed in a plane at equidistances from each other.

In operation the orifice areas ranged from about 0.015 $in^2$ for orifice 35 to about 0.12 $in^2$ for each of feed channel orifices 34.

The arc is ignited as follows:

1. The electrodes are brought in close proximity to each other, e.g., about 10 mm. A moderate flow of shielding gas is started and introduced via annular passage 15. The starting flow of gas is normally about 2 to about 8 grams per minute. The arc is then ignited using a momentary high frequency spark to form a conductive path between the closely spaced electrodes. With the main power supply turned on, a rapid spark to arc transition occurs.

2. Once the arc is ignited, the arc gap is increased to its desired value by withdrawing the cathode.

To start up and maintain stable operation of the arc, the following parameters have been employed:

| | |
|---|---|
| Arc current | 50–750 amps |
| Arc voltage | 50–235 volts |
| Arc gap | 0.3–1.0 centimeters (startup)<br>5–20 centimeters (operation) |
| Mass flow rate of inert gas (argon) | 3–10 grams/minute (inner shroud) |
| Mass flow rate of reactive steam | 0–50 grams/minute (each linear feed channel) |

3. When optimum conditions are obtained, that is, when the maximum column temperature is reached with total mass flow of the fluid medium well below the value which would reduce the angle $\alpha$ to less than about 40°, the powdered coal is entrained in the steam and introduced into the arc via linear feed channels 14. The amount of material entrained is kept initially low and slowly increased until the fraction of the mass flow of dense material is comparable to that of the entraining material. The optimum mass flow rate of shielding gas introduced via passage 15 is in the range of 4 to 15 gm/min., and the mass flow of carrier gas (fluid entraining medium) introduced via channels 14 is in the range of 50 to 160 gm/min.

At the point where the mass flow of entrained material is comparable to that of the carrier fluid medium, the window angle is enlarged and the mass flow may be increased further without serious loss of penetration into the column.

The powdered coal in steam is almost entirely projected into the column without loss of solids due to swirling or agglomeration.

PROCESS OF THE INVENTION

Figure 3:
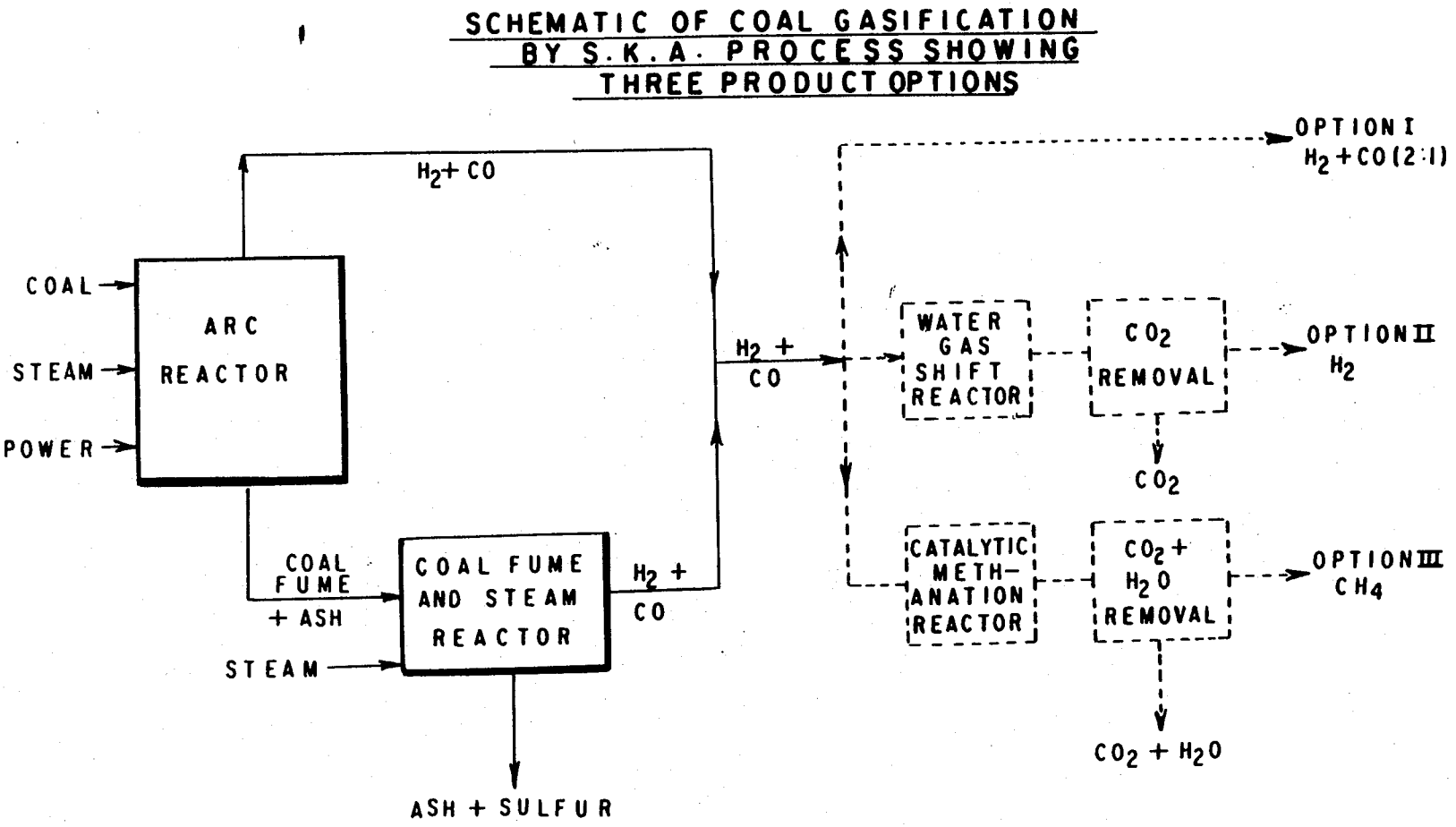
FIG. 3 is a schematic flow diagram of the process of the invention, showing three product options.

A simplified schematic flow sheet is presented in FIG. 3. The two main process steps are the arc treatment and the post-arc steam treatment. Three product options are also indicated as follows:

Option I: The outputs of both arc and post-arc reactors are combined and the $CO_2$ content removed to yield a low BTU gas suitable for power generation or other industrial uses.

Option II: By passing the combined $H_2+CO$ output through a shift reactor followed by $CO_2$ removal, a copious source of hydrogen is available.

Option III: Feeding the $H_2+CO$ mixture to a catalytic methanator yields a high BTU gas (essentially methane) suitable for pipeline use.

The following is a summary of the advantageous features of the pre-treatment step of the coal gasification process of the present invention:

1. The gas product is rich in hydrogen; approximate yield 60% $H_2$, 30% CO.
2. The solid product is finely divided, highly reactive carbonaceous fume, permitting completion of postarc gasification in a matter of seconds at moderate temperature and pressure, thus reducing size and cost of plant.
3. The technique of feeding coal in steam involves direct penetration into the plasma zone permitting very fast throughput of feed materials and low unit power consumption.
4. Autogenous desulfurization of product gases occur, thus eliminating the need for scrubbers, a major plant cost item.
5. Applicable to any type of coal or carbonaceous feed.
6. Method of feed directly into plasma arc eliminates tar formation.
7. No oxygen is required, improving process safety and eliminating the need for an oxygen plant.
8. Low water requirement compared with other technologies.
9. 95% carbon utilization.
10. Process is adaptable to automation, reducing manpower requirements.

The following specific embodiments are illustrative of the invention without being limitative in any respect.

EXAMPLES

Example 1

Open Arc Configuration

The initial attempts to feed coal and steam into an arc column were carried out in an open arc featuring an FCC nozzle at the cathode and a triple anode assembly used to permit the effluent to project vertically into the atmosphere where flammable products could ultimately be burned off under a cowl used to collect and vent the combustion products. The arc configuration is shown diagrammatically in FIG. 4. These tests showed that coal (−100 mesh) could be fed at high rates into the arc through the FCC nozzle using steam as the carrier gas, feed rates up to 5 lbs. coal/min. in 1.5 lbs. steam/min. were easily achieved while the arc was operating at as low as 92 KW (475 amps. at 193 volts) for a power/feed ratio of 0.24 KWH/lb. of feed material. Samples were withdrawn from the center of the effluent flame (just beyond the anodes) using water-cooled probes. The gas analysis was typically 60% $H_2$, 30% CO, 10% $CO_2$ (dry basis) with virtually no sulfur compounds. Frequently, small concentration of hydrocarbons were observed. The solids collected in this way was the coal "fume" typical of the solid arc product of coal "conditioned" by passage through the FCC arc. It was found to have a high surface area (80 $m^2$/gm) and reacted rapidly with steam in a separate tubular-fixed bed reactor at 800° C. yielding a gas product almost identical to that of the arc effluent.

Example 2

Small Enclosed Arc

The first attempt to carry out the arc treatment of coal and steam in an enclosed chamber utilized a cylindrical vessel eight inches in diameter and 16 inches long. (See FIG. (7)). Many difficulties were encountered in achieving stable arc operation within the enclosure, particularly as the injection of steam and coal were increased from low initial values. Eventually, however, the coal feed rate was increased from the earliest rates of 10 to 20 gm/min. to 250 gm/min. at 80 KW (2.4 KWH/lb.) with carrier steam up to 100 gm/min. The gas composition was quite similar to that obtained from the open arc tests, and the fume collected had high surface area and was likewise highly reactive when steam was used as the carrier gas. This was not the case, however, for runs made with nitrogen or argon as the carrier gas, and for runs with a modified FCC nozzle which resulted in poor penetration into the arc column. In the small chamber, the arc effluent was quenched with a water spray, which provided additional steam for the gasification reaction and, also, served to cool the arc chamber and to improve the arc stability.

Example 3

Large Enclosed Arc

On the basis of the results with the small enclosed arc, a new FCC was designed, somewhat larger than that used for the small enclosed arc chamber, which was shown to provide good penetration. (See FIG. (8)). The enclosure was much larger (24" in diameter by 30" high) in which the residence time of the feed materials after issuing from the arc was estimated to be ~1 second. Also, secondary steam was injected downstream of the arc to cool the chamber and to permit some gasification of fume particles in transit. At present, feed rates of 2.2 lbs. coal/min. and 0.5 lb. steam/min. have been achieved at an arc power level of 85 KW. This is equivalent to 0.64 KWH/lb. of coal, a marked improvement in unit power consumption over the smaller enclosed arc results. Approximately 40% of the carbon in the coal feed is gasified in the arc chamber. The remainder appears as coal fume. The gas analyzed approximately 62% $H_2$, 26% CO, 12% $CO_2$ over a wide range of feed rates. As in the other tests, virtually no sulfur was found in the gas product.

It is pointed out that the scale-up of the FCC nozzle used in the small enclosed arc to that used in the large enclosed arc resulted in an improvement in unit power consumption for the arc treatment step from 2.4 KWH/lb. of coal to 0.64 KWH/lb. of coal. However, Example 1 with the open FCC arc gave a value of 0.24 KWH/lb. of coal. It is apparent from the above examples that the unit power consumption is influenced by the size of the apparatus, with the larger units demonstrating lower unit power consumption. Also, comparison of the open arc experiment with those carried out in enclosed arc chambers, (which are essential for a practical process), indicates that the unit power consumption is also influenced by the chemical composition and ambient conditions within the arc chamber.

Example 4

Post-Arc Steam Treatment

Samples of the coal fume produced in each of the three arcs described above were retrieved, either by means of a probe (open arc) or by means of a fabric filter unit. This unit was effective in collecting about ⅓ of the coal fume produced, the remainder being so fine (100 $m^2$/gm.) that the material passed through the filter cloth.

The gasification reaction was carried out by placing the fume in a 1" ID stainless steel pipe forming a bed 6 to 7" deep with 15 to 30 gm. of fume depending on the degree of compression used. The pipe was placed in a tube furnace and the gasification temperatures determined by inserting an array of thermocouples in the bed. Steam flow through the bed was monitored with a small orifice in conjunction with a differential pressure cell. The effluent stream was cooled to condense excess steam and the condensate collected and measured. The non-condensible gases were analyzed by gas chromatography and by spectrophotometry. Gasification rates as a function of temperature at 80 psig are shown in FIG. 5. Also shown are data for the gasification rate for cnventionally devolatilized coal at 300 psig. Note that, despite the higher pressure, the gasification rate for the coal fume at temperatures above 900° C. is considerably higher than that for the devolatilized coal. Conversion efficiencies, based on ignition losses of charge and residue, were found to be between 84 and 92%. The composition of the product gas is shown in FIG. 6.

A lower temperatures (400° to 600° C.) high concentrations of methane were produced. The product gas was principally $CH_4$ and $CO_2$. At 400° to 500° we observed that methane (including minor amounts of higher hydrocarbons) comprised about 40% of the product gas. Since the formation of $CH_4$ from C and $H_2O$ in situ is practically isothermal, the production of appreciable quantities of $CH_4$ in the post-arc steam treatment results in a significant savings in process energy as well as in cooling water requirement.

It is evident from the above finding that the coal fume contains an active methanation catalyst. A separate investigation was initiated to determine the nature of this catalytic activity. The results strongly indicate that iron in the mineral matter is reduced and vapor deposited on silica, in which form it can catalyze the methanation of an $H_2$, CO mixture at temperatures below 700° C.

The design of the post-arc reactor depends on whether it is more advantageous to gasify the coal fume in transit in a flow-type reactor than to collect the fume and utilize a fixed-bed reactor as in the laboratory experiment. The flow-type reactor offers attractive features in simplicity and lower equipment cost, but requires a high gasification reaction velocity. FIG. 5 shows that adequate velocities may be achieved for the steam treatment of the arc fume product at temperatures in the range 800° to 1000° C. Using this route, the gasification of the fume requires 1,232 K-Cal/lb. of coal.

In order to take advantage of the high yield of methane from the fixed-bed steam treatment of fume at 400° to 600° C. and 80 psig, as indicated in FIG. 6, it is necessary to collect the ultra-fine coal fume issuing from the arc and design a fixed-bed reactor appropriate to the use of such fine material. The gasification reaction is appreciably slower at 600° C. and below. Against this disadvantage is the considerable saving in fuel cost (and cooling water requirement) to drive the reaction since the direct conversion of a carbon-steam mixture to $CH_4$ is approximately isothermal.

The preceding specific embodiments are illustrative of the practice of the invention. It is to be understood, however, that other expedients known to those skilled in the art, or disclosed herein, may be employed without departing from the spirit of the invention or the scope of the appended claims.

We claim:

1. A process for the gasification of coal consisting essentially of forming a free-burning arc discharge between at least one anode and a cathode having a conical tip, wherein said arc discharge forms a contraction of the current-carrying area in the transition region in the vicinity of the cathode, forcefully projecting a reactive material consisting of a mixture of pulverized coal and steam parallel to the surface of said conical tip of said cathode and through said contraction of the current-carrying area in the transition region in the vicinity of the cathode, at such a rate that said mixture of pulverized coal and steam is exposed to the free-burning arc for less than 3 milliseconds, and recovering the major portion of the coal fed in the form of a solid carbonaceous fume having a surface area in the range of 40 to 100 $m^2$/gm and the minor portion of the coal fed in the form of a gaseous product consisting of hydrogen, carbon monoxide and carbon dioxide.

2. The process of claim 1 wherein said mixture is exposed to the free-burning arc for about 1 millisecond.

3. The process of claim 2 wherein 50% to 80% of the carbon in the pulverized coal feed is recovered as said carbonaceous fume.

4. The process of claim 2 wherein the mixture ratio by weight of said mixture of pulverized coal and steam is from 1:1 to 4.4:1.

5. The process of claim 4 wherein said mixture ratio by weight is from 2.5:1 to 4.4:1.

6. A two-stage process for the gasification of coal consisting essentially of forming a free-burning arc discharge between at least one anode and a cathode having a conical tip, wherein said arc discharge forms a contraction of the current-carrying area in the transition region in the vicinity of the cathode, forcefully projecting a reactive material consisting of a mixture of pulverized coal and steam parallel to the surface of said conical tip of said cathode and through said contraction of the current-carrying area in the transition region in the vicinity of the cathode, at such a rate that said mixture of pulverized coal and steam is exposed to the free-burning arc for less than 3 milliseconds, recovering the major portion of the coal fed in the form of a solid carbonaceous fume having a surface area in the range of 40 to 100 $m^2$/gm and the minor portion of the coal fed in the form of a gaseous product comprised of hydrogen, carbon monoxide and carbon dioxide, reacting said solid carbonaceous fume with steam at elevated temperatures and pressures and recovering more of said gaseous product.

7. The process of claim 6 wherein said reaction of said carbonaceous fume with steam is conducted at temperatures of 800° C. to 1100° C. at pressures from atmospheric to 300 pounds per square inch gauge and said gaseous product consists of about 60% hydrogen, 30% carbon monoxide and 10% carbon dioxide.

8. The process of claim 6 wherein said reaction of said carbonaceous fume with steam is conducted at temperatures of 400° C. to 600° C. at pressures of from atmospheric to 300 pounds per square inch gauge and said gaseous product consists of about 40% methane, 5% hydrogen, 10% carbon monoxide and 42% carbon dioxide.

9. The process of claim 8 conducted in a flow-through reactor in the absence of an added methanation catalyst.

10. The process of claim 6 wherein said pulverized coal is a high sulfur coal containing mineral matter and said gaseous product is substantially free of a sulfur content without special desulfurization processes.

* * * * *